US011547882B1

(12) United States Patent
Towery

(10) Patent No.: US 11,547,882 B1
(45) Date of Patent: Jan. 10, 2023

(54) HAMMER ACTION PIKE POLE

(71) Applicant: Casey W. Towery, Irving, TX (US)

(72) Inventor: Casey W. Towery, Irving, TX (US)

( * ) Notice: Subject to any disclaimer, the term of this patent is extended or adjusted under 35 U.S.C. 154(b) by 741 days.

(21) Appl. No.: 16/507,891

(22) Filed: Jul. 10, 2019

Related U.S. Application Data

(60) Provisional application No. 62/725,903, filed on Aug. 31, 2018.

(51) Int. Cl.
*A62C 8/00* (2006.01)
*A62B 3/00* (2006.01)

(52) U.S. Cl.
CPC ..... *A62C 8/00* (2013.01); *A62B 3/005* (2013.01)

(58) Field of Classification Search
CPC ..... A62C 8/00; A62B 3/005; A01K 97/14; A47F 13/06; B25J 1/04; B66F 19/00
USPC ..... 294/175, 26
See application file for complete search history.

(56) References Cited

U.S. PATENT DOCUMENTS

| | | | | |
|---|---|---|---|---|
| 3,117,378 | A * | 1/1964 | Bowen | G01C 15/06 173/90 |
| 5,495,878 | A * | 3/1996 | McKenen, Jr. | B27L 7/005 173/90 |
| D726,520 | S * | 4/2015 | Trice | D8/81 |
| 9,198,337 | B2 * | 12/2015 | Walsh | A01B 1/026 |
| 9,868,202 | B1 * | 1/2018 | Burcham | B25G 3/36 |
| 2003/0192187 | A1 * | 10/2003 | Bean | A62B 3/005 30/164.6 |
| 2012/0272459 | A1 * | 11/2012 | Trice | A62C 8/00 7/158 |
| 2017/0057074 | A1 * | 3/2017 | D'Avignon | A01B 1/02 |

* cited by examiner

*Primary Examiner* — Justin M Jonaitis

(57) ABSTRACT

The present invention discloses a multi-purpose pike pole firefighting tool. The pike pole comprises a blade, a square shaft, an elongated handle member, a handle and an elongated tubular member. The blade of the pike pole is welded to the square shaft. The square shaft is disposed with in the elongated handle member and configured to move up and down within the elongated handle member. One end of the elongated tubular member is coupled to the elongated handle member by threading assembly via a connection sleeve and another end is coupled to one side of a receiver or cap and the handle is fastened to another side of the receiver. The pike pole uses a manually driven by a piston action or a hammer action to assist a user to remove wood shiplaps/walls of the fired structures for checking fire extension by opening walls and ceilings during firefighting operations.

5 Claims, 10 Drawing Sheets

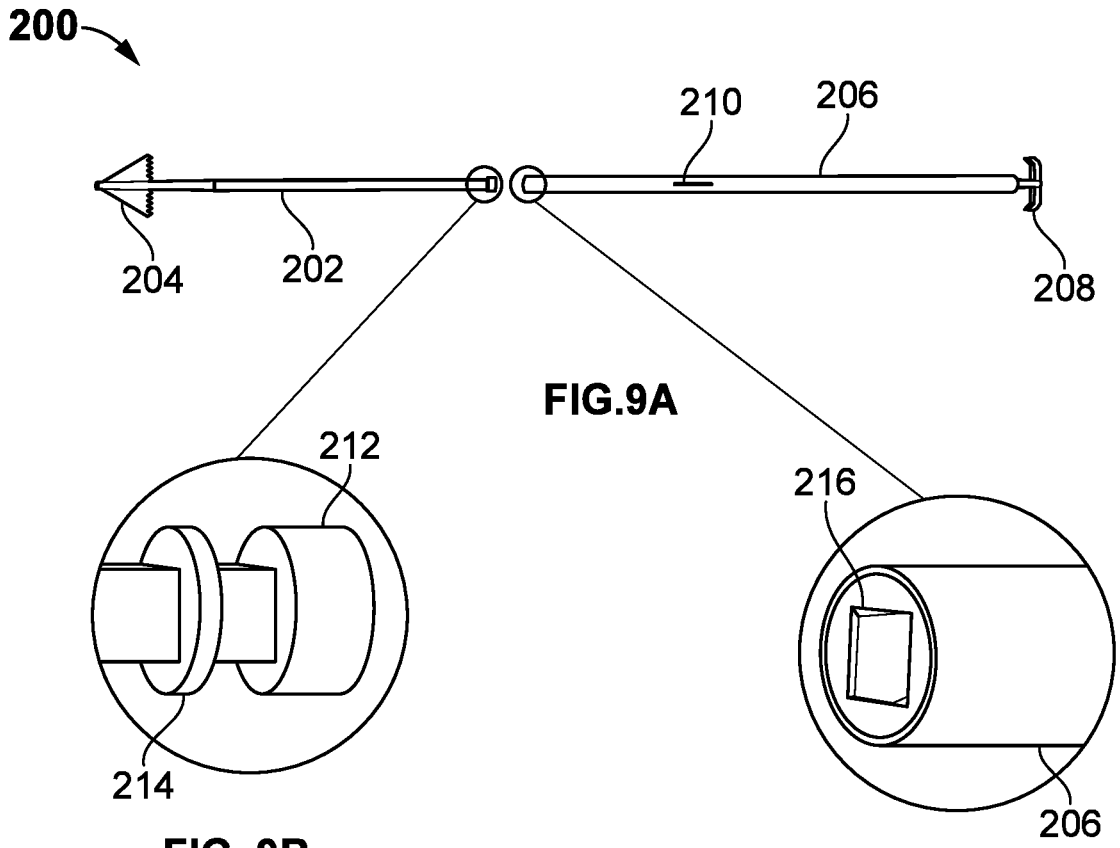
FIG.9A
FIG. 9B
FIG. 9C
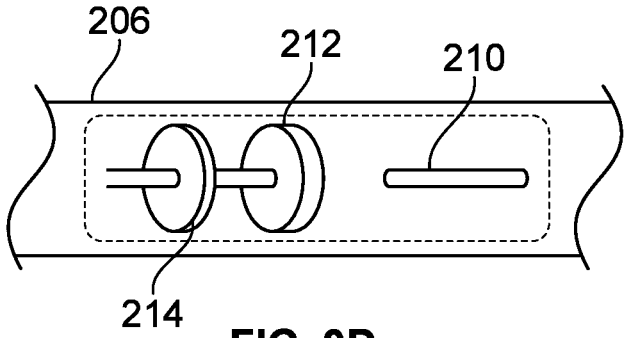
FIG. 9D

HAMMER ACTION PIKE POLE

BACKGROUND OF THE INVENTION

A. Technical Field

The present invention generally relates to a multi-purpose firefighting tool. More specifically, the present invention relates to a hammer action pike pole used to perform multiple operations such as hammering, sawing, piercing, battering for removing wood shiplaps or walls in firefighting operations.

B. Description of Related Art

Firefighters frequently find it necessary to gain entry through walls and ceilings in emergency situations for breaking away sections of a structure. Firefighters also need to create ventilation openings in structures to vent fire in the course of performing their duties. These and other operations often require the use of various firefighting tools, such as a pike pole.

In the $16^{th}$ century, syringes or reciprocating pumps were used in firefighting to prevent the rate of fire spread and extinguish the fire in the fired structures, buildings, vehicles, woodlands, etc. Bucket brigades were also a prevalent method of fighting fires. The effectiveness of these methods was insufficient and reserved for small fires. In the early $20^{th}$-century firefighting methods and equipment began to improve dramatically. The advent of powered pumps and extensive training for firefighters improved throughout the century resulting in advanced techniques and equipment developed specifically for fighting fires. The tools and training used in firefighting have specialized functions, and the manual application of individual devices is still required for firefighting personnel especially when entering a building or other structure experiencing a fire event.

For inspecting and ventilating or pulling structures in the firefighting operation, a pike pole is required. The pike pole is a long metal-topped wood, an aluminum, or fiberglass pole used for reaching, holding, or pulling the fired structures that are usually found on the walls or ceilings of the fired structures. The pike pole is a manual device consisting of a long metal or wood pole topped with a metal tip. The materials consist of wood shiplaps or boards that are fixed to the rafters or studs of the structure. Structures will also contain drywall or sheetrock that is used to finish out the interior of a home or business. The interior walls and ceiling that are covered by wood or drywall prevent adequate ventilation during firefighting, and these materials will also hide fire that has extended into the walls and ceiling.

The firefighter must manually use a pike to grasp and remove the wood coverings to allow ventilation and to expose fire extensions that may have progressed into the structure. Removing these materials is difficult requiring physical effort and is often done in limited visibility situations. The pike currently used in firefighting situations is a general-purpose tool and can often be inadequate for certain conditions where the materials are stubborn and involve great effort to remove. A more sophisticated tool could apply more force for removing wood wall coverings and drywall is needed for firefighters. The tool needs to be easily carried by the firefighter and be manually operated.

Currently, if the ceilings are clad with decorative wood shiplaps, these wood shiplaps could spread the fire easily in fired structures or buildings. If the ceilings are height, firemen or firefighters are typical cannot be reached from the floor without ladders, etc. For removing the wood shiplaps, a step ladder and a halligan tool (or axe) are most often used to open a gap and then pulled down with the pike pole. Swinging a halligan or axe on a stepladder is cumbersome and could lead to injuries. Using these tools, takes significant time and the fire could spread during, and increasing danger to the firemen or firefighters and additional building loss. Conventional pike poles are not providing security from a sharpened blade to the fireman or firefighter.

Therefore, there is a need to provide a pike pole used for hammering, cutting or sawing, piercing, and battering to remove the wood shiplaps/walls of the fired structures in firefighting operations. There is also a need to provide a pike pole to store in a less space by collapsing and carry easily for firefighting operations. There is also a need to provide a pike pole with a hammer or piston action to lessen a user effort for removing the wood shiplaps/walls of the fired structures. There is also a need to provide a pike pole for providing security to the fireman or firefighter from the sharpened blade when not in use.

SUMMARY OF THE INVENTION

The present invention generally discloses a multi-purpose firefighting tool. Further, the present invention discloses a pike pole used to perform multiple operations such as hammering, sawing, piercing, battering for removing wood shiplaps or walls in firefighting operations.

According to the present invention, the pike pole comprises a blade, a square shaft, an elongated handle member, a handle and an elongated tubular member. In one embodiment, the blade could be an arrowhead or a triangular shaped blade. In one embodiment, the blade is fastened to one end of the square shaft via a welding or robotic welding. In some embodiment, the blade is fastened to one end of the square shaft via an adhesive or a fastener. In one embodiment, the user could rotate the blade by rotating the handle of the pike pole.

In one embodiment, the square shaft is made of by using, but not limited to, a 0.75" cold drawn square rod stock. The square shaft includes a tip at a first end and a cylindrical collar affixed to a second end. In one embodiment, the square shaft is configured to slide or move up and down within the elongated handle member. In one embodiment, the square shaft is tapered at first end and fastened to a head or cylindrical collar via a welding technique or an adhesive or a fastener at the second end. The head or cylindrical collar is configured to locate and restrain the square shaft. The cylindrical collar is further configured to stop the hammer action when the cylindrical collar strikes to one end of the elongated handle member while removing and pulling large expanses of sheet rock and clad boards down from the wall and the ceiling surfaces using the handle. In one embodiment, the square shaft is configured to rotate by rotating the handle of the pike pole. In one embodiment, the square shaft is made of a material, but not limited to, medium tensile carbon steel, steel, iron and stainless steel. In one embodiment, the square shaft having a tip, used to remove building walls and wood shiplaps in firefighting operations.

In one embodiment, the elongated handle member having a length of 3.0' and it is a 2.0" round rod stock. In one embodiment, the elongated handle member having a retention area for the square shaft. In one embodiment, one end of the elongated handle member is formed in a square shape to accept the square shaft and another end is threaded on the external surface to fasten the elongated tubular member by threading assembly via a connection sleeve. In one embodiment, the elongated handle member could be a center shaft. In one embodiment, the elongated handle member is made of a material, but not limited to, stainless steel, steel and an iron material. In one embodiment, the elongated handle member is suitably connected to the elongated tubular member via a connection sleeve.

In one embodiment, the handle is fastened to the one end of the elongated tubular member via a receiver or a cap. The handle is attached to one end of the receiver or cap via an adhesive or a fastener. In one embodiment, the handle is configured to remove the sheet rocks and drywall section of fired structures or buildings in firefighting operation and pull clad boards down from the wall and the ceiling surfaces using the handle. In one embodiment, the handle could be a T-shaped handle. In one embodiment, the handle is made of a material, but not limited to, stainless steel, steel and an iron material.

In one embodiment, the handle could be a T-shaped handle. In one embodiment, the handle is made of a material, but not limited to, stainless steel, steel and an iron material. In one embodiment, one end of the elongated tubular member is threaded to mate with the connecting sleeve, and another end is inserted to fit into the receiver or cap of the handle and cross drilled. In one embodiment, the elongated tubular member is coated with a polyurethane material to seal the outer surface and provide a good grip in wet or dry environments. In one embodiment, the elongated tubular member is made of a material, but not limited to, a wood or a hickory hardwood. In one embodiment, the elongated tubular member could also be used as a handle. In some embodiments, elongated tubular member is made of a material, but not limited to, fiberglass and roughened slightly to provide the optimum grip for the user.

In one embodiment, the pike pole further comprises an aperture/opening or a door disposed on the elongated handle member. In one embodiment, the opening could be used to remove the debris and dust particles out of the drive impact area. In one embodiment, the strap is configured to secure the square shaft to the elongated handle member and prevents accidental movements of the square shaft. In one embodiment, the pike pole further comprises a leather sheath, configured to cover the blade. In one embodiment, the leather sheath is tethered to the shaft of the pike pole via a fastener.

In another embodiment, the pike pole comprises a square shaft, an arrowhead or a blade, an elongated handle member, and a handle. In one embodiment, the square shaft comprises a tip at a first end. The arrowhead is securely affixed to the tip at the first end of the square shaft. In one embodiment, the elongated handle member is configured to slidably receive the square shaft via an opening at one end. In one embodiment, a handle securely affixed to another end of the elongated handle member. The handle is configured to rapidly remove and pull large expanses of sheet rock and clad boards down from the wall and the ceiling surfaces. The handle provides a tight grip for the user.

In one embodiment, the arrowhead comprises inverted multiple teeth. The inverted multiple teeth of the arrowhead is configured to grab the ceiling or wall for safely pulling lap siding seams, sheet rock, and clad boards down using hammer action. In one embodiment, the square shaft further comprises a tip at a first end and a cylindrical collar securely affixed to a second end. The cylindrical collar is configured to stop the hammer action when the cylindrical collar strikes to a steel plate positioned within the elongated handle member. The steel plate is configured to stop the movement of the cylindrical collar within the elongated handle member. In one embodiment, the square shaft further comprises a stopper. The stopper is securely affixed to proximal to the cylindrical collar. The stopper is configured to stop the hammer action when the stopper strikes to the one end of the elongated handle member while removing and pulling large expanses of sheet rock and clad boards down from the wall and the ceiling surfaces using the handle.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

FIG. 9A shows a side view of a square shaft and an elongated handle member of the pike pole in another embodiment of the present invention.

FIG. 9B shows an enlarged view of a stopper and a cylindrical collar of the square shaft in another embodiment of the present invention.

FIG. 9C shows an enlarged view of an opening of the elongated handle member of the pike pole in another embodiment of the present invention.

FIG. 9D shows a sectional view of the elongated handle member of the pike pole in another embodiment of the present invention.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1A:
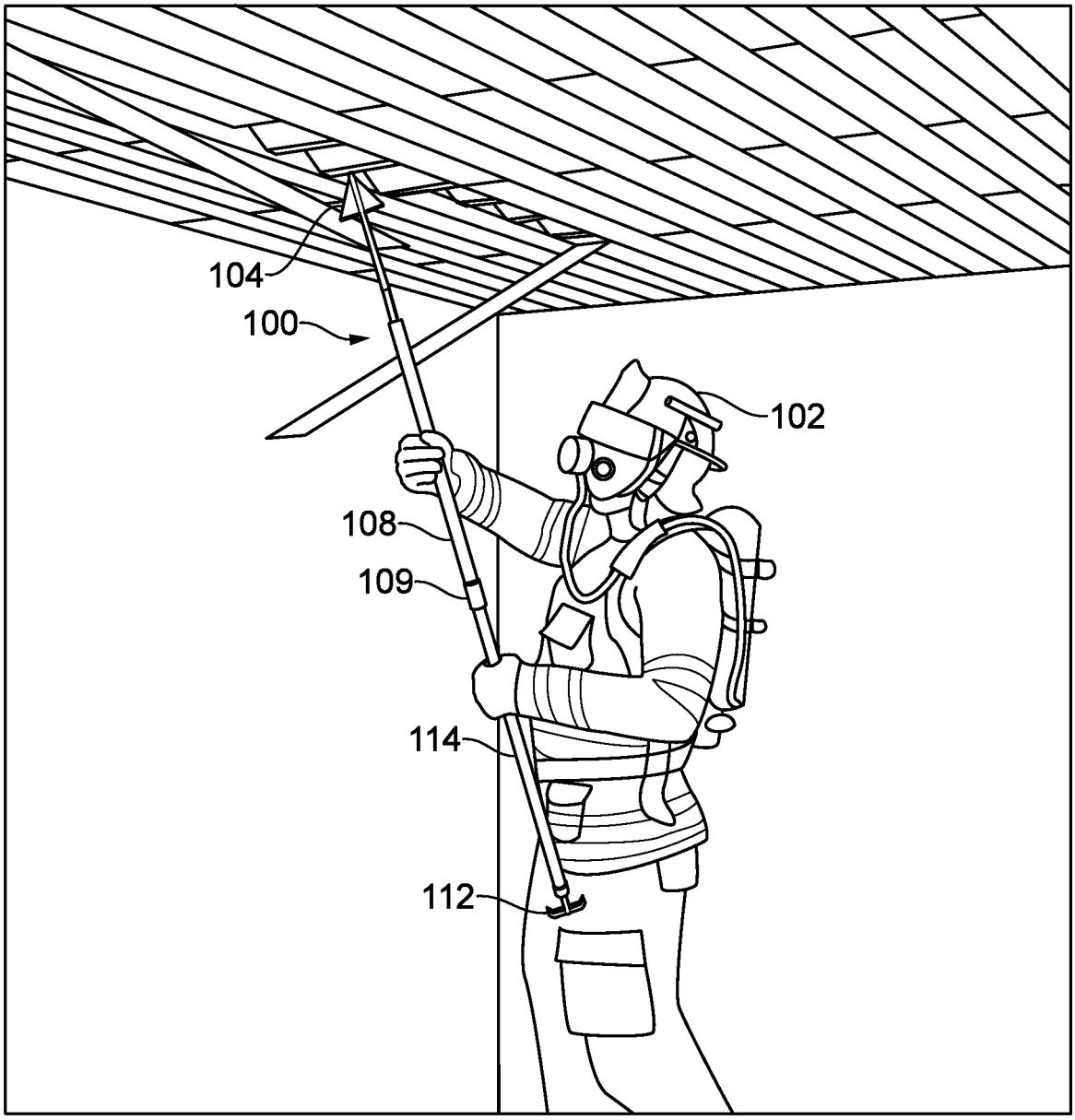
FIG. 1A shows a perspective view of a pike pole used by a user in an embodiment of the present invention.

Referring to FIG. 1A, the perspective view of a pike pole 100 using by a user 102 for removing wooden ceiling or wall in a building is illustrated. In one embodiment, the user 102 could hold the pike pole 100 by gripping with hands. In one embodiment, the pike pole 100 is configured to perform multiple operations such as sawing, piercing, and battering for removing the wood shiplaps or walls of fired structures or building in a firefighting operation. In one embodiment, the user 102 could check fire extensions by removing or opening walls and ceilings in fired structures or a building or in a vehicle. In one embodiment, the user could also use the pike pole 100 with a single hand.

Figure 1B:
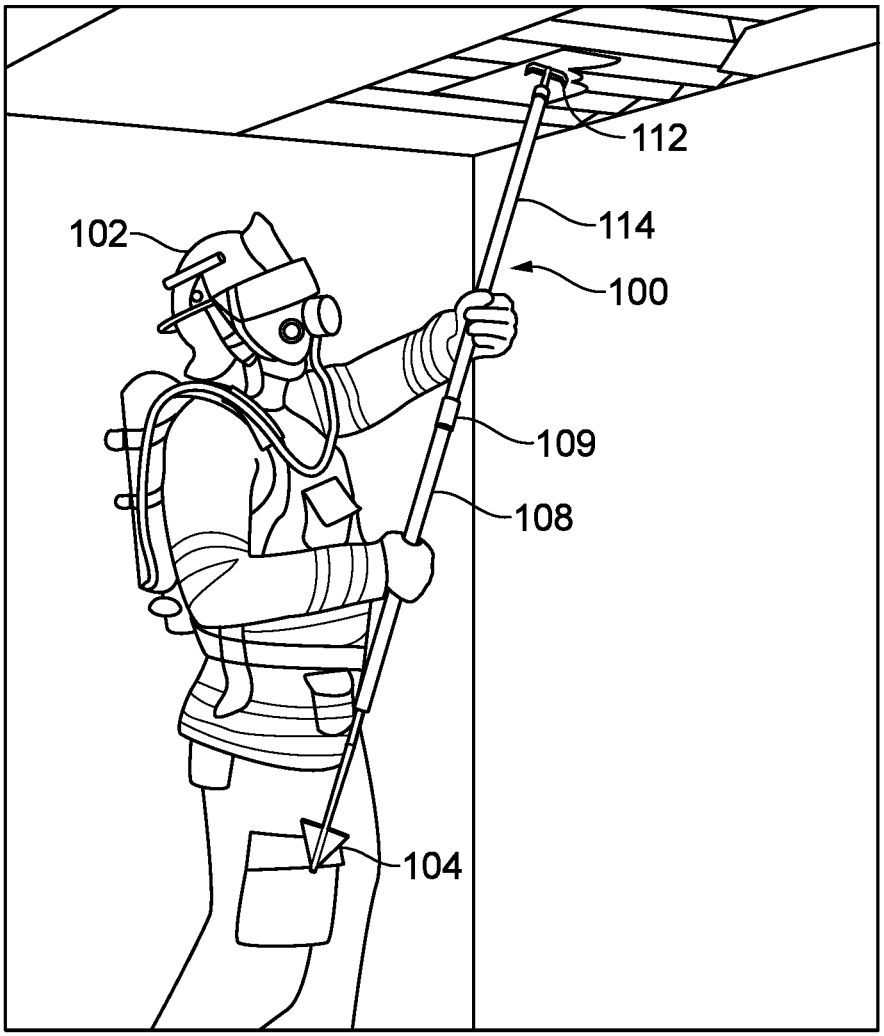
FIG. 1B shows a perspective view of a pike pole used by a user in one embodiment of the present invention.

Referring to FIG. 1B, the perspective view of a pike pole 100 using by a user 102 for removing sheet rock or drywall sections in a building is illustrated. In one embodiment, the user 102 could hold the pike pole 100 by gripping an elongated tubular member 114 positioned on up and gripping the elongated handle member 108 to down. In one embodiment, the pike pole 100 is configured to perform hammering, battering and pulling down the ceiling or wall of the fired structures or building in the firefighting operation. In one embodiment, the user 102 could be a firefighter or a fireman. In some embodiments, the pike pole 100 could be used in construction, logging, rescue and recovery, and power line maintenance. In one embodiment, the pike pole 100 could be a hammer action pike pole.

Figure 2A:
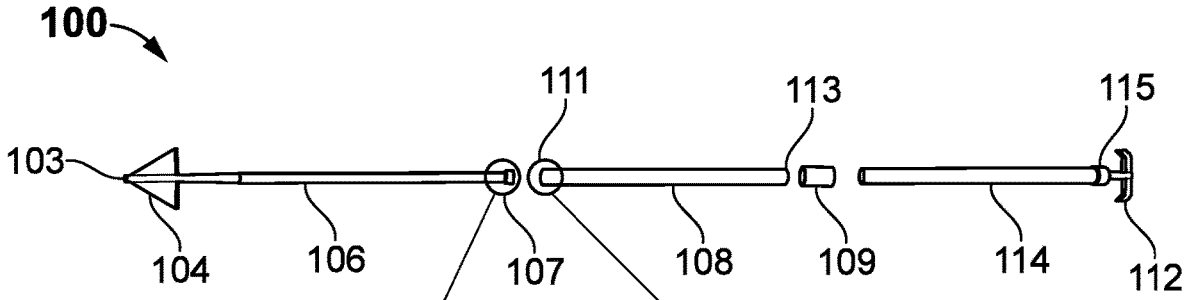
FIG. 2A shows a side view of a square shaft, an elongated handle ember, and an elongated tubular member with a handle of the pike pole in one embodiment of the present invention.

Referring to FIG. 2A, the front sectional view of a pike pole 100 is illustrated. In one embodiment, the pike pole 100 comprises a blade 104, a square shaft 106, an elongated handle member 108, a handle 112 and an elongated tubular member 114. In one embodiment, the blade 104 could be an arrowhead or a triangular shaped blade. The center of the blade 104 is milled to accept a tapered shaft with a chisel-shaped end. In one embodiment, the blade 104 is fastened to the first end of the square shaft 106 via a welding or robotic welding. After welding the assembled shaft is vibrationally deburred, cleaned, and prepared for paint. In some embodiment, the blade 104 is fastened to the first end of the square shaft 106 via an adhesive or a fastener.

Figure 2B:
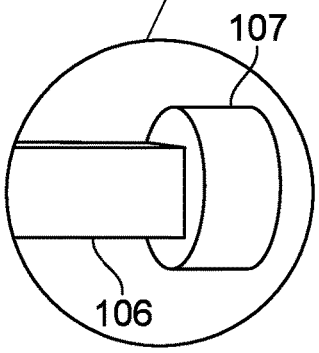
FIG. 2B shows an enlarged view of a head or cylindrical collar of the square shaft in one embodiment of the present invention.

Referring to FIG. 2B, shows an enlarged view of a head or cylindrical collar 107 of a square shaft 106 is illustrated. In one embodiment, the square shaft 106 is made of by using, but not limited to, a 0.75" cold drawn square rod stock. In one embodiment, the square shaft 106 is tapered at the first end and fastened to a head or cylindrical collar 107 via a welding technique or an adhesive or a fastener at the second end. The head or cylindrical collar 107 is used to locate and restrain the square shaft 106. The square shaft 106 is very durable, resists almost all bending moments without degradation. In one embodiment, the square shaft 106 is configured to rotate by rotating the handle 112 of the pike pole 100. In one embodiment, the square shaft 106 is made of a material, but not limited to, medium tensile carbon steel, steel, iron and stainless steel. In one embodiment, the square shaft 106 having a tip 103. In one embodiment, the tip 103 of the square shaft 106 could be used as a pick, or for cutting or sawing building walls and wooden shiplaps in firefighting operations.

Figure 2C:
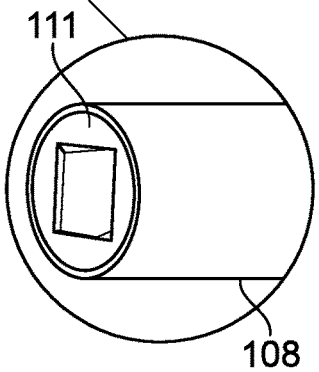
FIG. 2C shows an enlarged view of an opening of the enlarged handle member in one embodiment of the present invention.

FIG. 2C shows an enlarged view of one end of the enlarged handle member 108 is illustrated. In one embodiment, the elongated handle member 108 having a length of 3.0' and it is a 2.0" round rod stock. In one embodiment, the elongated handle member 108 having a retention area for the square shaft 106. In one embodiment, the elongated handle member 108 having two ends 111 and 113. In one embodiment, an opening at one end 111 of the elongated handle member 108 is formed in a square shape to accept the square shaft 106 and another end 113 is threaded on the external surface of the elongated handle member 108 via a CNC lathe machine. After the machining is completed, mating halves or connection sleeve 109 are fastened to the elongated handle member 108 in an automated jig and are robotically welded with a bead residing in the groove on each side. The bead will be slightly recessed in the groove and will aid in the grip on the tool during use. In one embodiment, the elongated handle member 108 could be a center shaft.

Figure 3A:
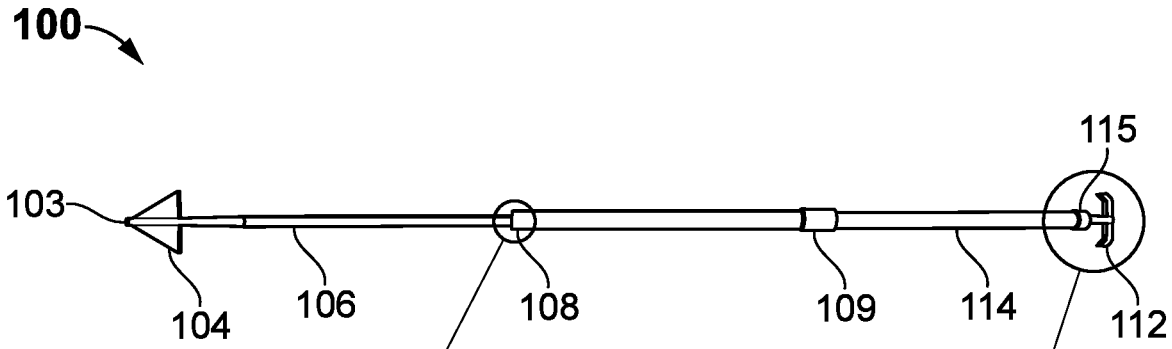
FIG. 3A shows a side view of the pike pole in one embodiment of the present invention.

Referring to FIG. 3A, the front view of a pike pole 100 is illustrated. In one embodiment, the elongated handle member 108 is suitably connected to the elongated tubular member 114 via a connection sleeve 109. In one embodiment, the square shaft 106 is disposed within the elongated handle member 108. In one embodiment, the square shaft 106 is configured to slide or move up and down within the elongated handle member 108. In one embodiment, another end of the elongated handle member 108 is fastened to one end of the connecting sleeve 109 via the threading assembly. The one end of the elongated tubular member 114 is connected to another end of the connecting sleeve 109 via threading assembly. In one embodiment, another end of the elongated tubular member 114 is fastened to one end of a receiver or cap 115 of the handle 112 via the threading assembly. In one embodiment, the handle 112 is fastened to another end of the receiver or cap 115 via an adhesive or a fastener.

Figure 3B:
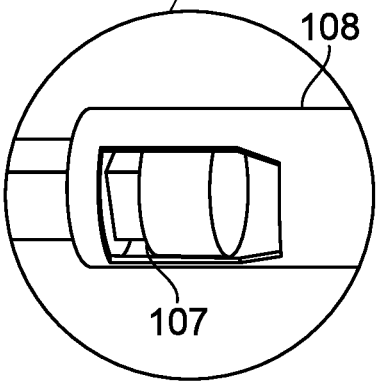
FIG. 3B shows an enlarged view of a head or cylindrical collar of the square shaft disposed within the enlarged handle member in one embodiment of the present invention.

Referring to FIG. 3B, shows an enlarged view of a head or cylindrical collar 107 of a square shaft 106 disposed within the enlarged handle member 108 is illustrated. In one embodiment, the head or cylindrical collar 107 is configured to strike the receiver or cap 115 at the end of the elongated tubular member 114 of the pike pole 100. In one embodiment, the head or cylindrical collar 107 is made of a material, but not limited to, steel, stainless steel or iron. The cylindrical collar 107 is further configured to stop the hammer action when the cylindrical collar 107 strikes to one end of the elongated handle member 108 while removing and pulling large expanses of sheet rock and clad boards down from the wall and the ceiling surfaces using the handle 112.

Figure 3C:
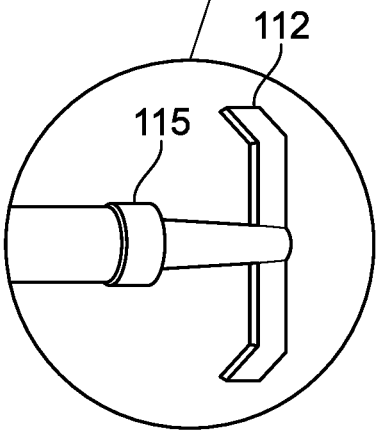
FIG. 3C shows an enlarged view of the handle of the pike pole in one embodiment of the present invention.

FIG. 3C shows an enlarged view of a handle 112 of the pike pole 100 is illustrated. In one embodiment, the handle 112 is fastened to the one end of the elongated tubular member 114 via the receiver or cap 115. The handle 112 is attached to one end of the receiver or cap 115 via an adhesive or a fastener. In one embodiment, the handle 112 could be a T-shaped handle. In one embodiment, the handle 112 is made of a material, but not limited to, stainless steel, steel and an iron material. In one embodiment, one end of the elongated tubular member 114 is threaded to mate with the connecting sleeve 109, and another end is inserted to fit into the receiver or cap 115 of the handle 112 and cross drilled. In one embodiment, the elongated tubular member 114 is coated with a polyurethane material to seal the outer surface and provide a good grip in wet or dry environments. In one embodiment, the elongated tubular member 114 is made of a material, but not limited to, wood or hickory hardwood. In one embodiment, the elongated tubular member 114 could also be used as a handle. It is formed into a 2" diameter shaft and is polished on a CNC lathe for smoothness. In some embodiments, the elongated tubular member 114 is made of a material, but not limited to, fiberglass and roughened slightly to provide the optimum grip in wet or dry conditions, even when gloves are worn.

Figure 4A:
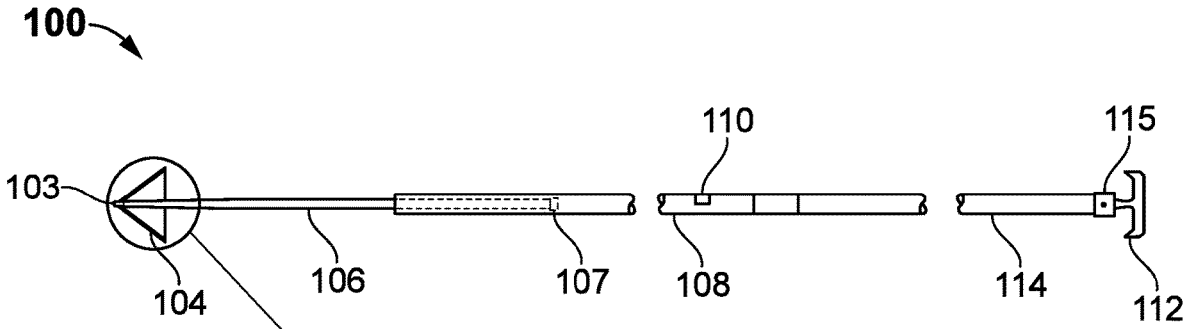
FIG. 4A shows a side sectional view of the pike pole in one embodiment of the present invention.
Figure 4B:
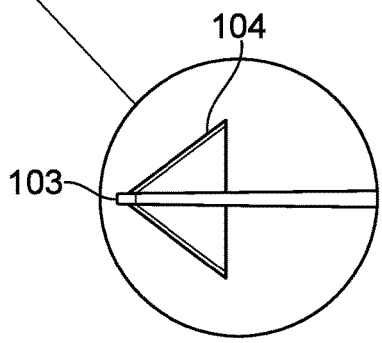
FIG. 4B shows an enlarged view of a blade of the pike pole in one embodiment of the present invention.

Referring to FIGS. 4A and 4B, the side sectional view of a pike pole 100 and an enlarged view of the blade 104 are illustrated. In one embodiment, the square shaft 106 is configured to move or slide in and out within the elongated handle member 108. The blade 104 is sharpened and has a triangular shape and it could be safely pulled down with a small effort. The square shaft 106 allows the blade 104 to be positioned and then driven up through the lap siding with a few strokes and then rotated to position the base across the siding. Then the pike pole 100 could be pulled downward, safely and efficiently removing the ceiling boards from the floor. In one embodiment, the elongated handle member 108 allows the end of the square shaft 106 to strike it and impart the force to the blade 104. In one embodiment, the handle 112 allows easy rotation of the blade 104 and the pike pole 100 could be reversed to pull a sheet rock off the wall or ceiling in firefighting operations. The handle 112 is configured to remove large expanses of sheet rock and pull clad boards down from the wall and the ceiling surfaces. The elongated tubular member 114 has exceptional bending resistance. In one embodiment, the pike pole 100 further comprises an aperture/opening or a door 110 disposed on the elongated handle member 108. In one embodiment, the opening 110 is configured to allow dirt and debris within the elongated handle member to outside of the drive impact area of the pile pole 100.

Figure 5:
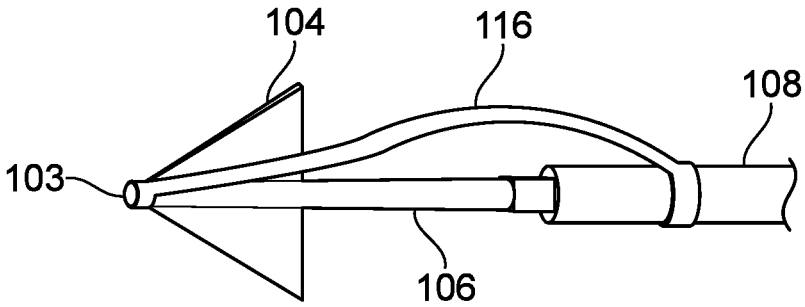
FIG. 5 shows a side view of the blade and the square shaft locked to the elongated handle member by a strap in one embodiment of the present invention.

Referring to FIG. 5, the front view of a blade 104 attached to a square shaft 106 locked to an elongated handle member 108 via a strap 116 is illustrated. In one embodiment, the square shaft 106 is locked to an elongated handle member 108 via a strap 116. In one embodiment, one end of the strap 116 could be wrapped around the elongated handle member 108 and another end of the strap 116 could be wrapped around a tip of the blade 104. In one embodiment, the strap 116 is configured to secure the square shaft 106 to the elongated handle member 108 and prevents accidental movements of the square shaft 106 when not in use. In one embodiment, the pike pole 100 further comprises a leather sheath, configured to cover the blade 104. In one embodiment, the leather sheath is tethered to the shaft of the pike pole 100 via a fastener.

Figures 6A, 6B:
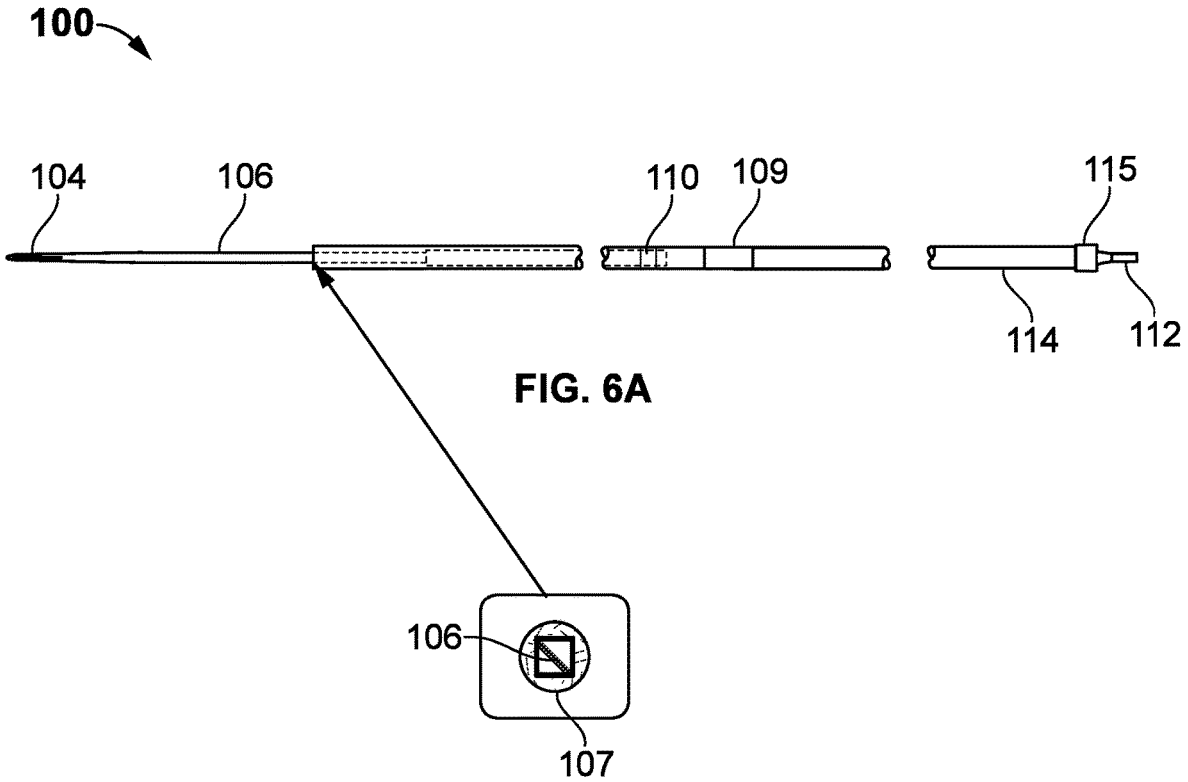
FIG. 6A shows a side sectional view of a pike pole in one embodiment of the present invention.
FIG. 6B shows an end view of the square shaft in one embodiment of the present invention.

Referring to FIG. 6A, the side sectional view of a pike pole 100 is illustrated. In one embodiment, the handle 112 could be molded part. After molding, the handle 112 is vibrationally deburred to remove flash and polish on the surface of the handle 112. In operation, the pike pole 100 is used to open the wooden shiplaps or sealings for inspection and ventilation. The pike pole 100 could be operated by manually driven piston action to assist the user 102 (shown in FIG. 1A) or firefighter when checking for fire extensions by opening walls and ceilings. At one step, the user 102 (shown in FIG. 1A) could force the blade 104 and the tip 103 of the pike pole 100 into the ceiling or wall by unlocking the square shaft 106. At another step, the user 102 (shown in FIG. 1A) could drive the pike pole 100 to and fro from the wood ceiling or wall by using the hammer action. The downward movement of the square shaft 106 could impact or hit the receiver or cap 115, so the pike pole 100 creates a hammer force assisting the user 102 (shown in FIG. 1A) in pulling down the wood ceiling or wall. The travel and impact of the hammer action require less force by the user 102 (shown in FIG. 1A) to accomplish the work of removing the wood shiplap from the wall or ceiling.

In another embodiment, the pike pole 100 could be used to remove the sheetrock or drywall sections by using the handle 112. For removing the sheetrock or drywall sections, at one step, the user 102 (shown in FIG. 1B) could reverse the pike pole 100. At another step, the user (shown in FIG. 1B) could force the handle 112 and hit on the sheetrock or drywall sections for removing from the ceiling. The pike pole 100 eliminates the need for a second tool to be carried for firefighting operation. This action quickly and with little effort, safely pulls the board clad ceilings down and exposes the joists, rafters, etc. so the fire can be fought from below. After use, the pike pole 100 could be collapsed, the leather sheath is installed to a portion of the blade 104, and the pike pole 100 could be stored in a place. In one embodiment, the square shaft 106 is strong and the elongated handle member 108 resists the harshest use and bending moments without any degradation. Referring to FIG. 6B, the end view of a square shaft 106 is illustrated. In one embodiment, the square shaft 106 is welded to the head or cylindrical collar 107.

Figure 7A:
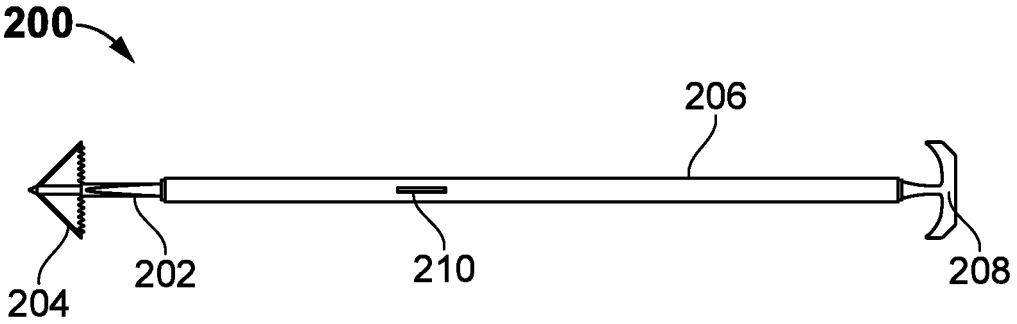
FIG. 7A shows a side view of the pike pole in another embodiment of the present invention.
Figure 7B:
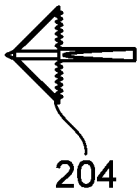
FIG. 7B shows an enlarged view of a blade of the pike pole in another embodiment of the present invention.
Figure 7C:
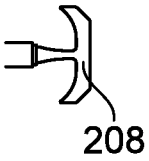
FIG. 7C shows an enlarged view of a handle of the pike pole in another embodiment of the present invention.

Referring to FIGS. 7A-7C, the pike pole 200 used to remove wooden ceiling or wall in a building is disclosed. In another embodiment, the pike pole 200 is configured to perform multiple operations such as sawing, piercing, and battering for removing the wood shiplaps or walls of fired structures or building in a firefighting operation. In one embodiment, the user could check fire extensions by removing or opening walls and ceilings in fired structures or a building or in a vehicle using the pike pole 200. In one embodiment, the user could also use the pike pole 200 with a single hand. In another embodiment, the pike pole 200 comprises a square shaft 202, an arrowhead or a blade 204, an elongated handle member 206, and a handle 112. In one embodiment, the blade 204 could be a triangular shaped blade. In one embodiment, the square shaft 202 comprises a tip at a first end. The arrowhead 204 is securely affixed to the tip at the first end of the square shaft 202. The arrowhead 204 is configured to force into a ceiling or a wall for safely pulling down lap siding seams using hammer action. In one embodiment, the arrowhead 204 comprises inverted multiple teeth. The inverted multiple teeth of the arrowhead 204 is configured to grab the ceiling or wall for safely pulling lap siding seams, sheet rock, and clad boards down using hammer action. In one embodiment, the elongated handle member 206 is configured to slidably receive the square shaft 202 via an opening 216 (shown in FIG. 9C) at one end.

In one embodiment, the handle 208 comprises a T-shaped structure. The handle 208 securely affixed to another end of the elongated handle member 206. The handle 208 is configured to rapidly remove and pull large expanses of sheet rock and clad boards down from the wall and the ceiling surfaces. The handle 204 provides a tight grip for the user. In one embodiment, the handle 204 is made of a material, but not limited to, stainless-steel.

Figure 8:
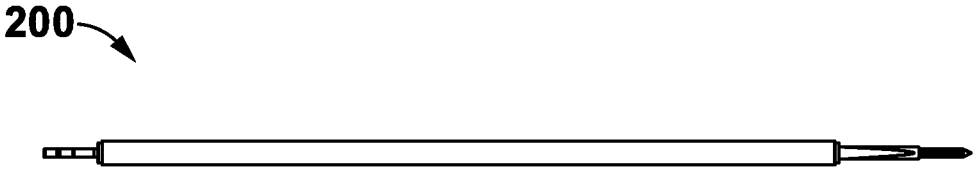
FIG. 8 shows a side view of the pike pole in another embodiment of the present invention.

Referring to FIG. 8, the pike pole 200 used for opening ship-lap/wooden ceilings and walls for inspection and ventilation is disclosed. In one embodiment, the pike pole 200 has a length of about, but not limited to, 57.88". In one embodiment, the elongated handle member 206 has a diameter of about, but not limited to, 1.50". In one embodiment, the arrowhead 204 has a width of about, but not limited to, 6" and the handle has a width of about, but not limited to, 6".

Referring to FIGS. 9A-9D, the square shaft 202 of the pike pole 200 positioned into the elongated handle member 206 is disclosed. In one embodiment, the square shaft 202 is slidably positioned into the elongated handle member 206 via the opening 216 at one end. In one embodiment, the square shaft 202 further comprises a tip at a first end and a cylindrical collar 212 securely affixed to a second end. The cylindrical collar 212 is configured to stop the hammer action when the cylindrical collar 212 strikes to a steel plate 210 positioned within the elongated handle member 206. The steel plate 210 is configured to stop the movement of the cylindrical collar 212 within the elongated handle member 206. In one embodiment, the square shaft 202 further comprises a stopper 214. The stopper 214 is securely affixed to proximal to the cylindrical collar 212. The stopper 214 is configured to stop the hammer action when the stopper 214 strikes to the one end of the elongated handle member while removing and pulling large expanses of sheet rock and clad boards down from the wall and the ceiling surfaces using the handle 208. In one embodiment, the pike pole 200 is further configured to collapse and secured using the strap 116 (shown in FIG. 3B) or a leather sheath.

The pike pole 100 is designed to be aesthetic and effective in the application. The relative ease of manufacture and the moderately inexpensive components provide good marketability for the manufacturer. The firefighter benefits from the improved capability to remove ceiling coverings and sheet rock, which should provide considerable market interest in the product.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A multiple purpose hammer action pike pole, comprising:

a square shaft having a blade at a first end and a cylindrical collar affixed to a second end;

an elongated handle member having a first end and a second end, said first end having a square opening that telescopically and slidably receives said square shaft;

an elongated tubular member connected to the second end of said elongated handle member;

a handle securely affixed to the elongated tubular member, whereby when said handle is rotated, said square opening rotates said shaft to allow the user to reorient said blade; and wherein said blade is triangular with a pointed front end that penetrates a predetermined architectural material and a lower edge including a plurality of inverted teeth for gripping and pulling down said architectural material.

2. The pike pole of claim 1 wherein the square opening has a diameter smaller than said collar to prevent said square shaft from separating from said elongated handle member when a user is removing and pulling sheet rock and clad boards from a wall or a ceiling.

3. The pike pole of claim 2, wherein the elongated handle member includes an aperture configured to allow dirt and debris within the elongated handle member to be removed.

4. The pike pole of claim 1, wherein the handle is T-shaped to enhance a user's grip when pulling said pike pole and to pull sheet rock when said pole is inverted.

5. The pike pole of claim 1 further comprising a strap further securing the square shaft to said elongated handle member.

* * * * *